United States Patent [19]

Nemecek et al.

[11] 4,100,660

[45] Jul. 18, 1978

[54] APPARATUS FOR THE HEAT TREATMENT OF RUNNING THREADS BY MEANS OF SATURATED STEAM

[75] Inventors: Franz Nemecek, Dusseldorf; Edgar Muschelknautz, Leverkusen; Wolfgang Lindner, Dormagen; Herbert Preiss, Leverkusen, all of Germany

[73] Assignee: Bayer Aktiengesellschaft, Leverkusen, Germany

[21] Appl. No.: 832,756

[22] Filed: Sep. 12, 1977

[30] Foreign Application Priority Data

Sep. 29, 1976 [DE] Fed. Rep. of Germany ..... 2643787

[51] Int. Cl.[2] ..... D02G 1/16

[52] U.S. Cl. ..... 28/271; 68/5 D

[58] Field of Search ..... 28/271, 272, 273, 274, 28/275, 276; 68/5 D; 34/151, 152

[56] References Cited

U.S. PATENT DOCUMENTS

| | | | |
|---|---|---|---|
| 2,631,385 | 3/1953 | Kinraide | 68/5 D |
| 2,664,009 | 12/1953 | Emerson | 68/5 D |
| 2,920,346 | 1/1960 | Jori | 68/5 D |
| 3,022,566 | 2/1962 | Daniels et al. | 28/271 X |
| 3,952,386 | 4/1976 | Joly et al. | 28/271 |

*Primary Examiner*—Louis K. Rimrodt

*Attorney, Agent, or Firm*—Burgess, Dinklage & Sprung

[57] ABSTRACT

Running threads are fed through a heating chamber containing saturated steam by means of specially designed shutters. The thread is heated over a short section of the path so that the heating apparatus takes up little space even at high thread speeds.

9 Claims, 12 Drawing Figures

(A-A)

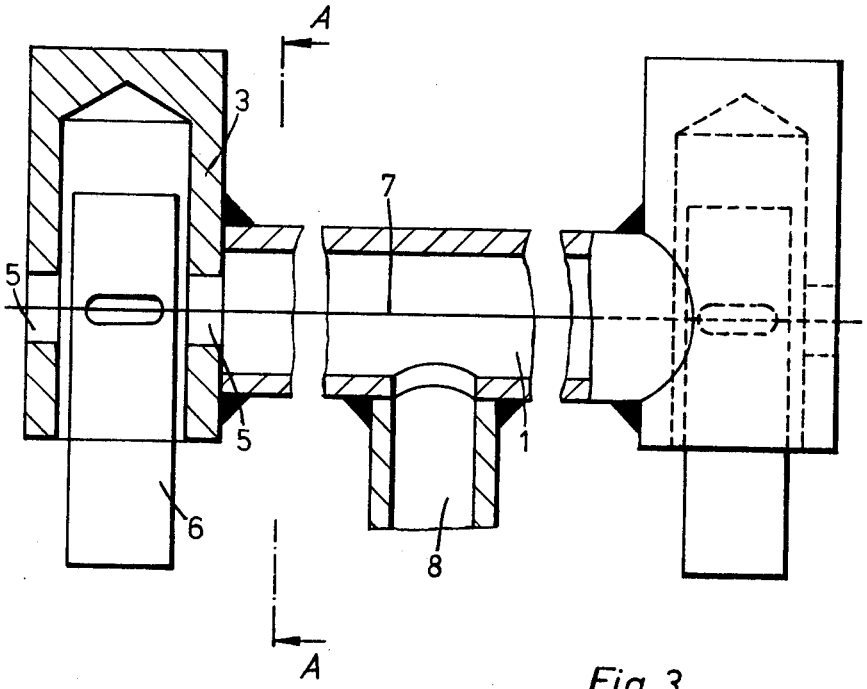
Fig.3
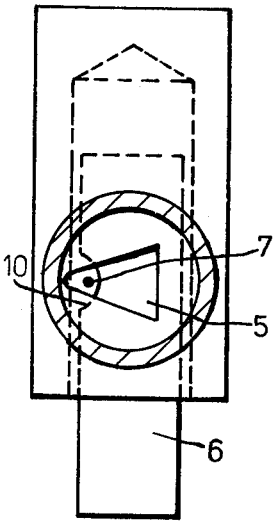
Fig.4 (A-A)
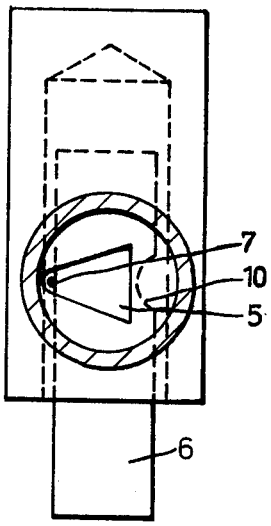
Fig.5 (A-A)

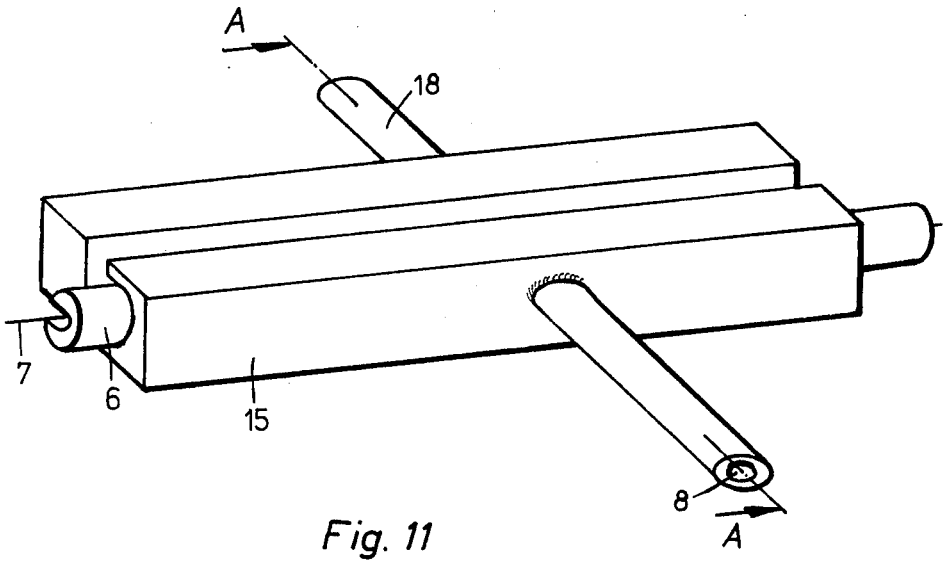
Fig. 11
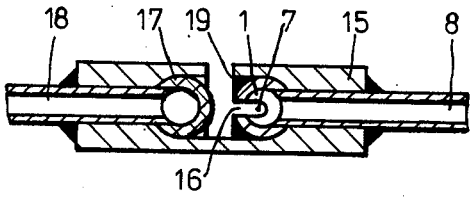
Fig. 12 (A-A)

APPARATUS FOR THE HEAT TREATMENT OF RUNNING THREADS BY MEANS OF SATURATED STEAM

The invention relates to an apparatus for the heat treatment of running threads, comprising a heating chamber which contains saturated steam and has openings in the walls through which the thread travels.

Apparatus of this type is required in the production of synthetic textile threads. Attempts are currently being made to provide processes in which spinning, drawing and texturising treatments are carried out immediately after one another, without sacrificing the high thread spinning velocity conventionally used, and indeed, if possible, further increasing it. In these high speed spinning processes with directly consecutive drawing and texturising treatments, the thread must generally be heated as it travels along the thread path. At high thread speeds, the section through which the thread must pass before it reaches the desired temperature is many meters long when the conventional methods of heating threads involving heat radiation or sliding contact with a heated rod are used. It is possible to heat threads intensively and carefully if the heat of condensation of saturated steam is given off directly on to the thread. However, at present no such apparatus exists for heating running threads in a satisfactory manner.

The object of the invention is to provide an apparatus with which running synthetic textile threads may be rapidly heated to the temperature of steam by condensing saturated steam on the threads. The operation of the apparatus should be such as to involve a low occurrence of obstruction in the apparatus, easy serviceability, economic feasibility and a low degree of disturbance to the environment.

According to the invention, there is provided an apparatus for the heat treatment of running threads, comprising a heating chamber having openings in the walls thereof through which, in use, the thread travels, shutters for varying the area of the said openings, and means for supplying saturated steam to the heating chamber.

The apparatus according to the invention has the particular advantage of using relatively simple means to provide rapid heating, and thus heating over a short path length so that even at high speed the apparatus requires little space along a thread path.

By altering the pressure in the heating chamber, it is possible also to alter the thread temperature.

The insertion of the thread into the apparatus is simple.

Very little steam escapes through the restricted openings in the walls of the heating chamber so that the place of work with which the apparatus is situated does not suffer through noise or the escape of a large quantity of steam.

The outlay required for production and for maintainance is very low.

In an advantageous form of the apparatus according to the invention, pressure releasing chambers are arranged before and after the heating chamber in the direction of thread travel. The area of the openings for allowing the thread into and out of the pressure release chambers may be adjusted by means of a shutter in the same way as the openings on opposite sides of the heating chamber. The steam is thus almost completely prevented from flowing out of the apparatus, and air conditioning which is conventionally provided in the room where the apparatus is situated, is not affected.

The apparatus according to the invention is shown in the accompanying drawings, in which:

FIGS. 3 to 6 show a heating chamber in which shutters for restricting the openings are rotatable about an axis which runs perpendicularly to the thread.

FIGS. 11 and 12 show a heating chamber with a sealable longitudinal slit in the heating chamber.

Figure 2:
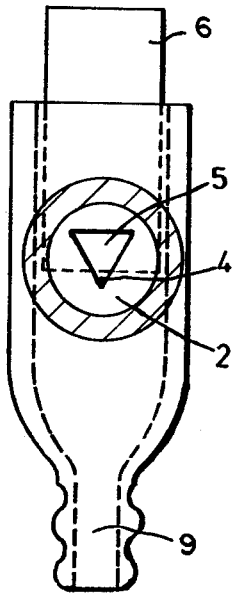
FIGS. 1 and 2 show a heating chamber having a movable restricting shutters for the size of the openings therein.
Figure 1:
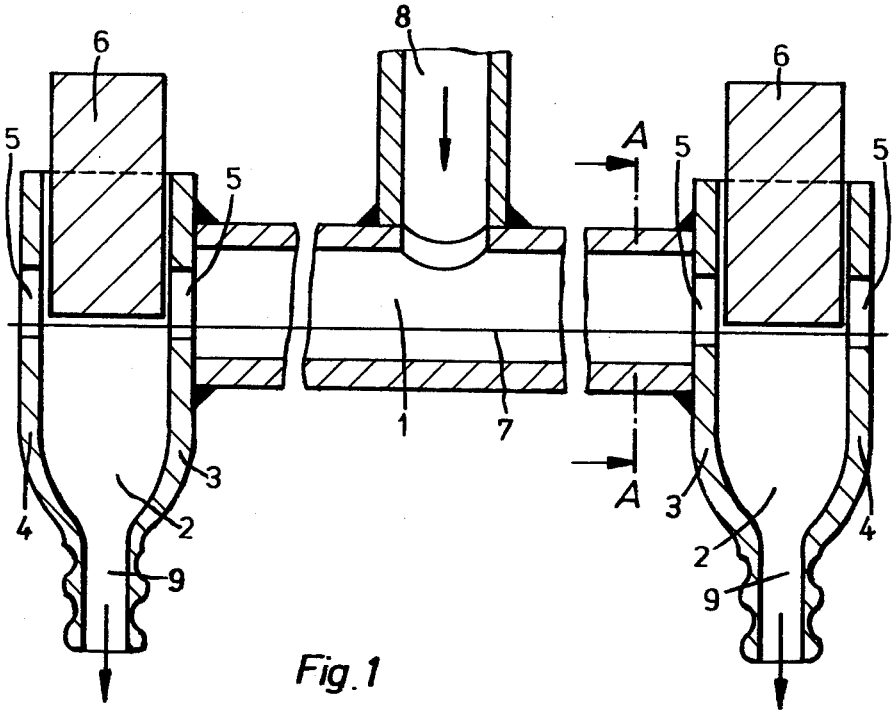

In FIG. 1, the heating chamber 1 comprises a tube 1000 mm long with an internal diameter of 10 mm. Tubes of about 70 mm in length, whose interiors define chamber 2 for pressure release are fixed to opposite sides of the heating chamber, perpendicularly to the direction of travel of the thread 7. Aligned openings 5 are provided in the walls 3 between the heating chamber and pressure release chambers as well as in the walls 4 between the pressure release chambers and the external room. In this embodiment, the openings 5 are each approximately in the shape of an isosceles triangle having an apex which lies approximately on the axis of the heating chamber. The openings 5 are shown in FIG. 2 which is a section on line A—A in FIG. 1. Variation in the area of the openings 5 may be obtained by moving substantially cylindrical shutters 6. When the shutters 6 are moved in, the thread 7 is pressed into the apex of the triangular opening 5 and an adequate seal is obtained in this way. Saturated steam is supplied via an inlet 8 and condensate is led off via outlets 9.

In order to insert the thread, the shutters are withdrawn and the thread is pulled through the chamber by a suction pistol. After restricting the openings 5, the thread may be heated to over 100° C by increasing the pressure of the saturated steam.

The embodiment has the advantage of being simple and cheap to construct. The four openings along the thread path are closable by two shutters. The heating chamber is suitable for yarn of any denier.

FIG. 3 shows another embodiment of the apparatus according to the invention, in which the area of the openings is variable by rotating a shutter. Where the parts are the same as in the preceding embodiment, they are given the same reference numerals. The opening 5 has the shape of an isosceles triangle with the apex to one side.

Extreme positions of the shutters are shown in FIGS. 4 and 5. The seal provided in sufficient.

Figure 6:
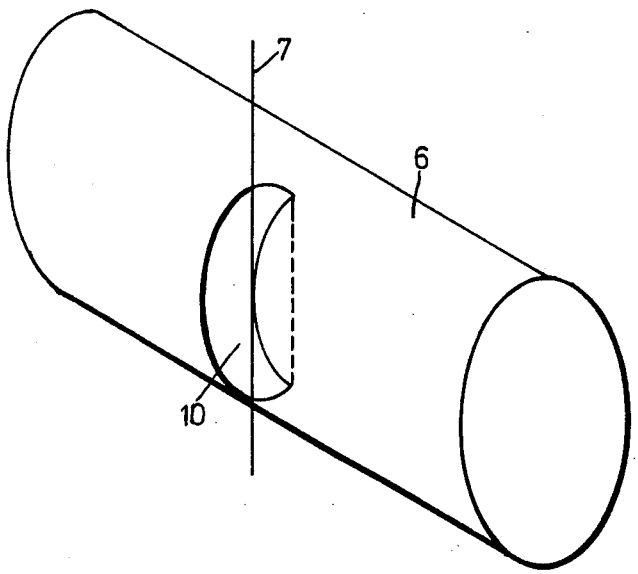

The cylindrical shutter 6 is shown in perspective in FIG. 6. A slit 10 is milled out for increasing the area of the wall openings for threading.

Figure 7:
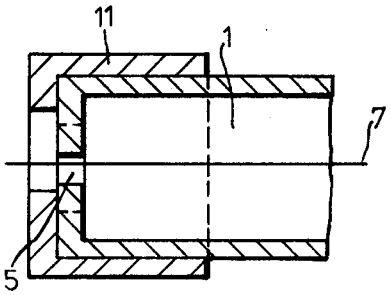
FIGS. 7 to 9 show a heating chamber having shutters for restricting the opening which is rotatable about an axis which is parallel to the direction of the thread path.
Figure 8:
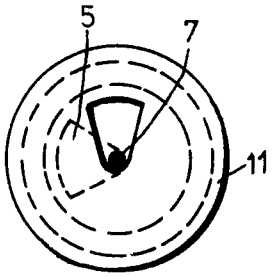

Another embodiment of the apparatus according to the invention is shown in FIGS. 7 and 8. This has an opening 5, which is the shape of an approximately triangular sector, in each wall of the heating chamber 1. Shutters 11 are located in the manner of caps over both ends of the heating chamber. Openings are provided therein which are similarly shaped to those in the ends of the heating chamber. For threading, the shutters are rotated so that the openings are aligned with each other. In FIG. 8, the shutter is rotated through about 90° into the operating position. The seal of the heating chamber is sufficient.

Figure 9:
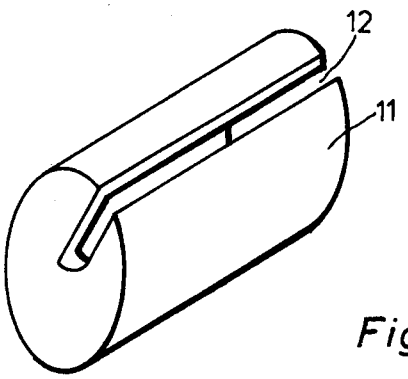

FIG. 9 shows another form of cap-like shutter 11, in which the opening in the shutter opens in the form of a slit which extends outwards from the centre and continues along the side wall 12 of the casing. With shutters of this type, it is possible in many cases to completely dispense with walls on the ends of the heating chamber 1. The thread is therefore particularly easily drawn into the heating chamber when the shutters are removed. When the thread is running through the apparatus under tension, the shutter may be simply applied. The shutter is suitable for threads of a relatively low denier.

Figure 10:
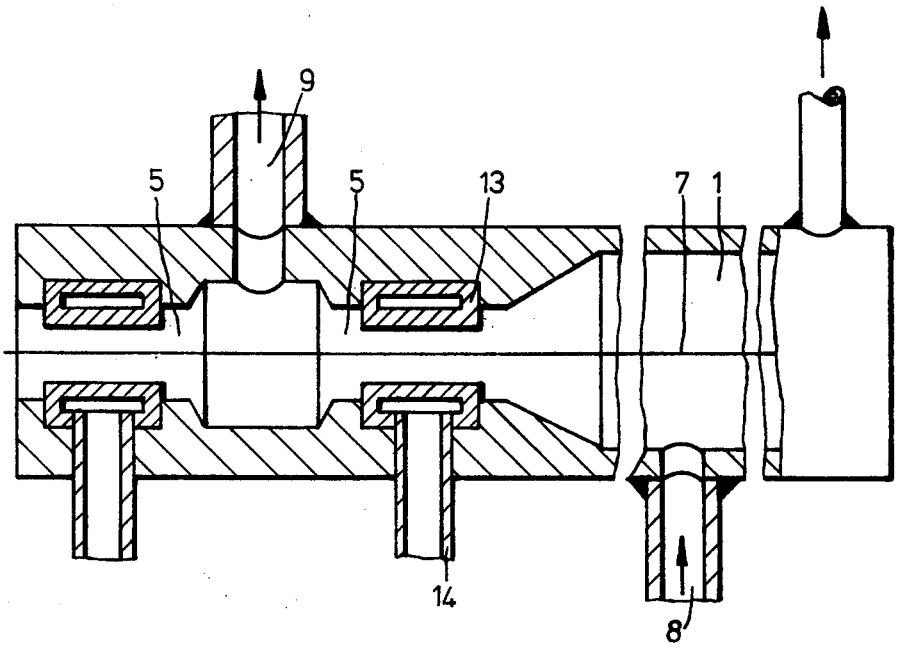
FIG. 10 shows a heating chamber in which shutters for restricting the opening are operable by pressure.

In another embodiment shown in FIG. 10, the area of the openings 5 is variable by means of a compressed fluid (for example compressed air). Shutters 13 are provided which are in the form of circular tubes composed of an elastic material. When subjected to pressure 14, the internal diameter of the openings 5 diminishes. This embodiment allows for simple operation and is particularly advantageous in automatically operating installations. The reference numerals have the same significance as in the first embodiment.

FIGS. 11 and 12 show a heating chamber which provides for very simple insertion of the running thread under tension at high speeds. A tubular heating chamber 1 has a slit 16 which extends along the entire casing surface (see FIG. 12). The ends of the slit open into the openings in the wall. The heating chamber is embedded in a housing 15 by means of a sealing compound 19. In this embodiment, rapidly running threads may be inserted particularly easily in the heating chamber. In order to seal the longitudinal slit 16, an elastic tube 17 lying opposite the heating chamber is subjected to pressure via tube 18 and then lies against the slit wall of the heating chamber and seals the latter. This apparatus is advantageous in automatically operating machines and also with threads of high denier. What we claim is:

1. An apparatus for the heat treatment of running threads, comprising a heating chamber having openings in the walls thereof through which, in use, the thread travels, shutter means for varying the area of the said openings, and means for supplying saturated steam to the heating chamber.

2. An apparatus according to claim 1, further comprising pressure release chambers connected to the heating chamber before and after the heating chamber in the direction of thread travel, wherein openings are provided in walls between the heating chamber and the pressure release chambers as well as in the walls between the pressure release chambers and the exterior, said shutter means including shutters for adjusting the area of said openings in the walls.

3. An apparatus according to claim 2, wherein the shutters are slidable.

4. An apparatus according to claim 2, wherein each shutter is rotatable about an axis which extends perpendicularly to the direction of thread travel.

5. An apparatus according to claim 2, wherein said openings are generally triangular, and the shutters in their closed position cover the openings except for a small area at the apex of the triangle.

6. An apparatus according to claim 1, wherein the shutter means comprise shutters and wherein each shutter is rotatable about an axis which extends parallel to the direction of thread travel.

7. An apparatus according to claim 6, wherein shutters are in the form of caps having an end wall and a side wall and a slit-shaped opening which extends outwardly from the centre of the end wall and thence along the length of the side wall.

8. An apparatus according to claim 2, wherein the shutters are in the form of tubular rings of resilient material connectable to a source of fluid medium under pressure which, when supplied to the rings, causes the size of the openings defined thereby to be reduced.

9. An apparatus according to claim 1, wherein the heating chamber has a closable longitudinal slit therein.

* * * * *